US006526605B2

(12) United States Patent
Shimizu

(10) Patent No.: US 6,526,605 B2
(45) Date of Patent: Mar. 4, 2003

(54) AUTOMATIC HAIR WASHER

(75) Inventor: Hirohisa Shimizu, Osaka (JP)

(73) Assignee: Oohiro Works, Ltd., Osaka (JP)

( * ) Notice: Subject to any disclaimer, the term of this patent is extended or adjusted under 35 U.S.C. 154(b) by 0 days.

(21) Appl. No.: 09/961,500

(22) Filed: Sep. 24, 2001

(65) Prior Publication Data

US 2002/0050005 A1 May 2, 2002

(30) Foreign Application Priority Data

Nov. 1, 2001 (JP) ..... 2000-334997

(51) Int. Cl.[7] ..... A45D 44/10
(52) U.S. Cl. ..... 4/523; 4/575.1
(58) Field of Search ..... 4/515–523, 575.1

(56) References Cited

U.S. PATENT DOCUMENTS 570,107 A * 10/1896 Slee ..... 4/523
1,588,293 A * 6/1926 Bailey ..... 4/523
2,854,969 A * 10/1958 Nolan ..... 4/518 X
3,026,537 A * 3/1962 Schnell ..... 4/523 X
5,896,595 A * 4/1999 Spencer ..... 4/519
5,970,532 A * 10/1999 Modica ..... 4/523
6,038,713 A * 3/2000 Grosse ..... 4/575.1

FOREIGN PATENT DOCUMENTS

GB 625529 * 6/1949 ..... 4/523
JP 6078824 * 3/1994 ..... 4/519

* cited by examiner

*Primary Examiner*—Charles E. Phillips
(74) *Attorney, Agent, or Firm*—Wall Marjama & Bilinski LLP

(57) ABSTRACT

An automatic hair washer comprises a hair washing cistern into which the head of a person whose hair is to be washed can be inserted, and hair washing means for spouting hot water into the hair washing cistern to wash the hair of the person, and further, a head support for supporting the head of the person in the hair washing cistern. Therefore, the automatic hair washer can wash the back of the neck of the person sufficiently, without putting a big burden on the neck.

4 Claims, 8 Drawing Sheets

AUTOMATIC HAIR WASHER

FIELD OF THE INVENTION

The present invention relates to an automatic hair washer which washes the hair of a person and, more particularly, to an automatic hair washer which can wash the back of the neck of the person sufficiently without putting a heavy burden on his neck.

BACKGROUND OF THE INVENTION

FIG. 9 is a sectional side elevation view illustrating a hair washing cistern of a prior art automatic hair washer. In the figure, reference numeral 201 denotes a hair washing cistern. Numeral 202 denotes a shower nozzle for spouting hot water, which is positioned on the inner wall of the hair washing cistern 201. Numeral 203 denotes an overhead shower nozzle for spouting hot water to the forehead of a person whose hair is being washed. Numeral 204 denotes a neck rest which is positioned on the front wall of the hair washing cistern 201.

In the prior art automatic hair washer, as shown in FIG. 9, a person whose hair is to be washed puts his neck on the neck rest 204 in a posture of lying on his back, and inserts his head into the hair washing cistern 201. In this state, shampoo, hot water, or the like is spouted from the shower nozzle 202 and the overhead shower nozzle 203 toward his hair to wash it. At this time, since his neck is covered with the neck rest 204, the hot water spouted from the shower nozzle 202 does not reach the back of his neck and, as a result, the back of his neck cannot be washed sufficiently. Further, as shown in FIG. 10, when his head is inserted into the hair washing cistern 201 deeply in order to wash the back of his neck sufficiently, a heavy burden caused by supporting his own head in the hair washing cistern is put on his neck.

As described above, in the prior art automatic hair washer, when the head of the person whose hair is to be washed is inserted deeply into the hair washing cistern 201 in order to wash the back of his neck sufficiently, a heavy burden caused by supporting his own head in the hair washing cistern is put on his neck.

SUMMARY OF THE INVENTION

The present invention is made to solve the above-described problems and has for its object to provide an automatic hair washer which can sufficiently wash the back of the neck of a person whose hair is washed, without putting a heavy burden on his neck.

Other objects and advantages of the present invention will become apparent from the detailed description and specific embodiments described are provided only for illustration since various additions and modifications within the spirit and scope of the invention will be apparent to those of skill in the art from the detailed description.

According to a first aspect of the present invention, there is provided an automatic hair washer comprising a hair washing cistern into which the head of a person whose hair is to be washed can be inserted from the front, and hair washing means for spouting hot water into the hair washing cistern to wash the hair of the person, and this automatic hair washer further comprises a head support for supporting the head of the person in the hair washing cistern.

According to a second aspect of the present invention, in the automatic hair washer according to the first aspect, the head support comprises a support leg an end of which is attached to the bottom of the hair washing cistern; and a head support bar which is attached to the other end of the support leg, and comes in contact with the back of the head of the person to support the head.

According to a third aspect of the present invention, in the automatic hair washer according to the second aspect, the head support rotates backward and forward about an end of the support leg attached to the bottom of the hair washing cistern, thereby having the standing state in which the head support stands up on the bottom of the hair washing cistern, and the falling state in which the head support falls down to be parallel with the bottom of the hair washing cistern.

According to a fourth aspect of the present invention, in the automatic hair washer according to the third aspect, the hair washing cistern has a deep portion in its back; and the head support bar is used as a hair receiver for receiving the hair of the person so that the hair hangs down into the deep portion of the hair washing cistern, in the state where the head support falls.

According to a fifth aspect of the present invention, in the automatic hair washer according to any of the first to fourth aspects, the head support is provided with a cushioning material in a part where it comes in contact with the head of the person.

According to a sixth aspect of the present invention, in the automatic hair washer according to any of the first to fifth aspects, wherein the hair washing means comprises a plurality of shower nozzles for spouting hot water toward the hair on the back and side of the head of the person, which nozzles are fixed to the inner wall of the hair washing cistern; and an overhead shower nozzle for spouting hot water toward the hair on the forehead of the person, which nozzle is fixed on the upper surface of the rear edge of the hair washing cistern.

DETAILED DESCRIPTION OF THE PREFERRED EMBODIMENTS

Embodiment 1

Hereinafter, an automatic hair washer according to a first embodiment of the present invention will be described with reference to drawings.

Figure 1:
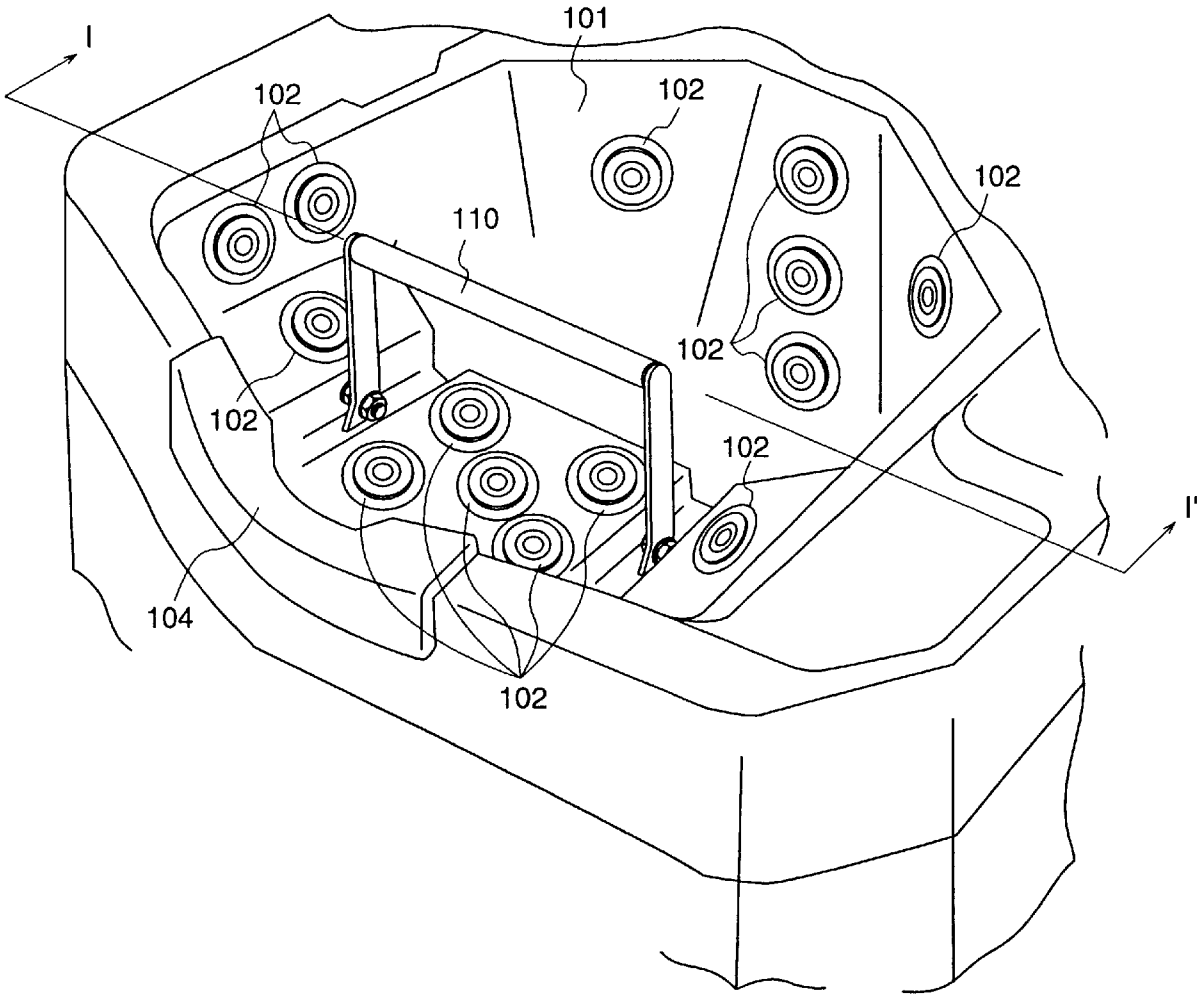
FIG. 1 is a perspective view of a hair washing cistern of an automatic hair washer according to a first embodiment of the present invention.
Figure 2:
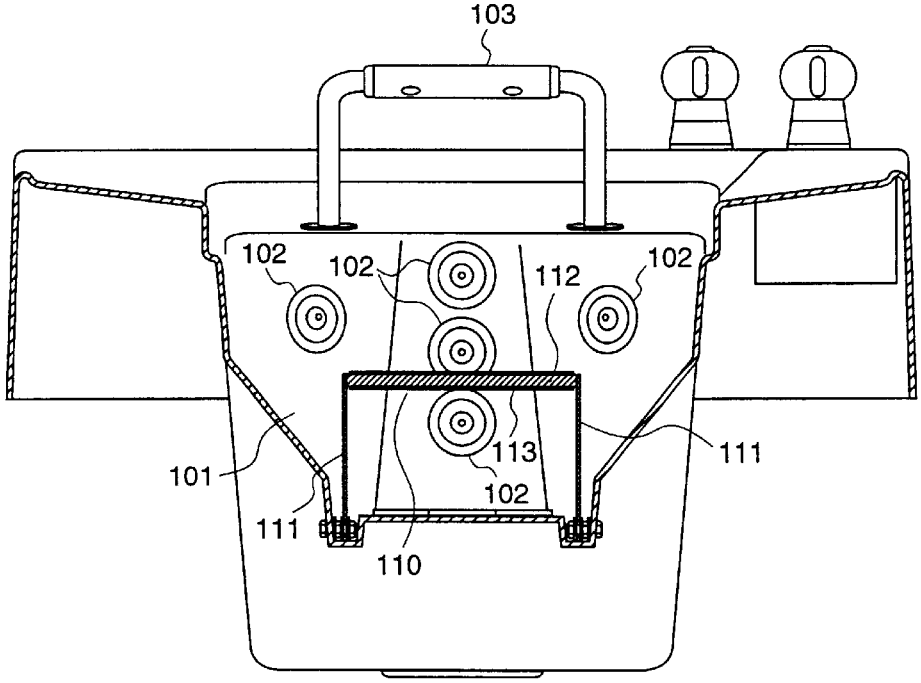
FIG. 2 is an I–I' line cross-sectional view of FIG. 1.

FIG. 1 is a perspective view of a hair washing cistern of an automatic hair washer according to the first embodiment of the present invention. FIG. 2 is a front sectional view of the hair washing cistern, taken along an I–I' line in FIG. 1. In these figures, reference numeral 101 denotes the hair washing cistern into which the head of a person whose hair is to be washed is inserted. Numerals 102 and 103 denote a hair washing means by which hot water is spouted into the hair washing cistern to wash the hair of the person. Numeral 102 denotes a shower nozzle which is positioned on the inner wall of the hair washing cistern 101, and spouts hot water toward the hair on the back and side of the head of the person. Numeral 103 denotes a U-shaped overhead shower nozzle which is positioned on the upper surface of the rear edge of the hair washing cistern 101, and spouts hot water toward the hair on the forehead of the person. Numeral 104 denotes a neck rest which is positioned on the front wall of the hair washing cistern 101. Numeral 110 denotes a head support which is positioned in the hair washing cistern. Numeral 111 denotes a support leg. Numeral 112 denotes a head support bar. Numeral 113 denotes a cushioning material which covers the head support bar 112.

Figure 3:
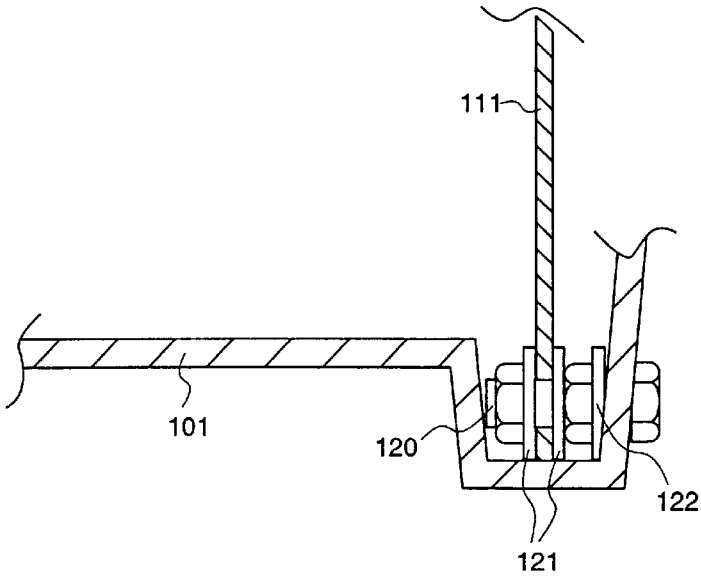
FIG. 3 is an enlarged view of a part where a head support 110 is attached to a hair washing cistern 101.
Figure 4:
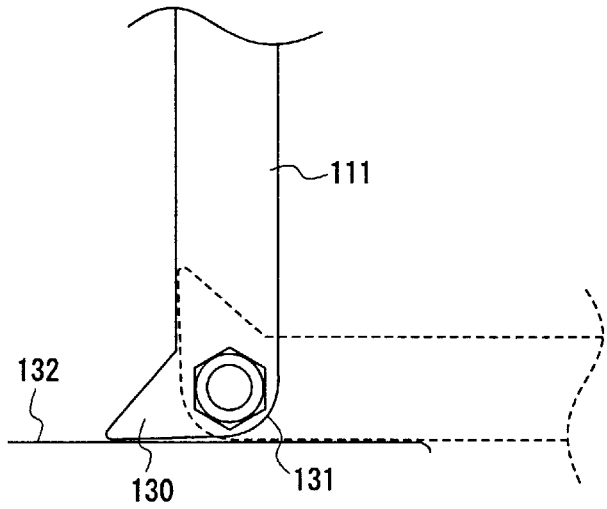
FIG. 4 is a diagram for explaining the movement of the head support.
Figure 5:
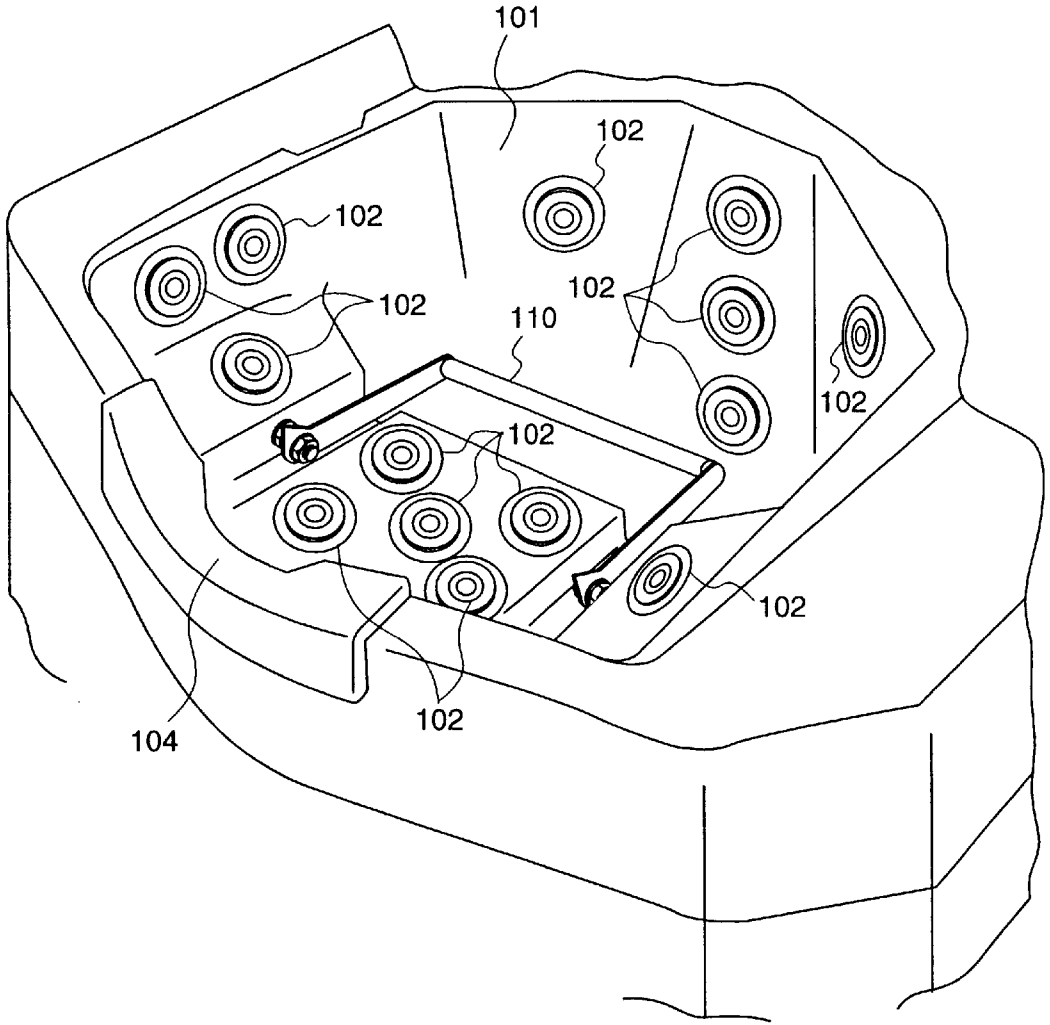
FIG. 5 is a perspective view of the hair washing cistern when the head support 110 is in the falling state.

FIG. 3 is an enlarged view of a part where the head support 110 is attached to the hair washing cistern 101. In the figure, the same reference numerals as those shown in FIG. 2 denote the same or corresponding parts. Numerals 120, 121, and 122 denote a support axis, a washer, and a packing, respectively. FIG. 4 is a diagram for explaining the movement of the head support 110. In the figure, a rotation stopper 130 is provided at the lower end of the front side of the support leg 111. A lower end 131 of the back side of the support leg 111 is rounded. The support leg 111 rotates about the support axis 120, and brings the head support 110 to a falling state as shown by a broken line in FIG. 4 and to a rotation stop position wherein the bottom of the rotation stopper 130 comes in contact with the bottom 132 of the hair washing cistern 101, i.e., a standing state as shown by a solid line in FIG. 4. FIG. 5 is a perspective view of the hair washing cistern when the head support is in the falling state, in the automatic hair washer according to the first embodiment.

Hereinafter, the operation of the automatic hair washer will be described.

Figure 6:
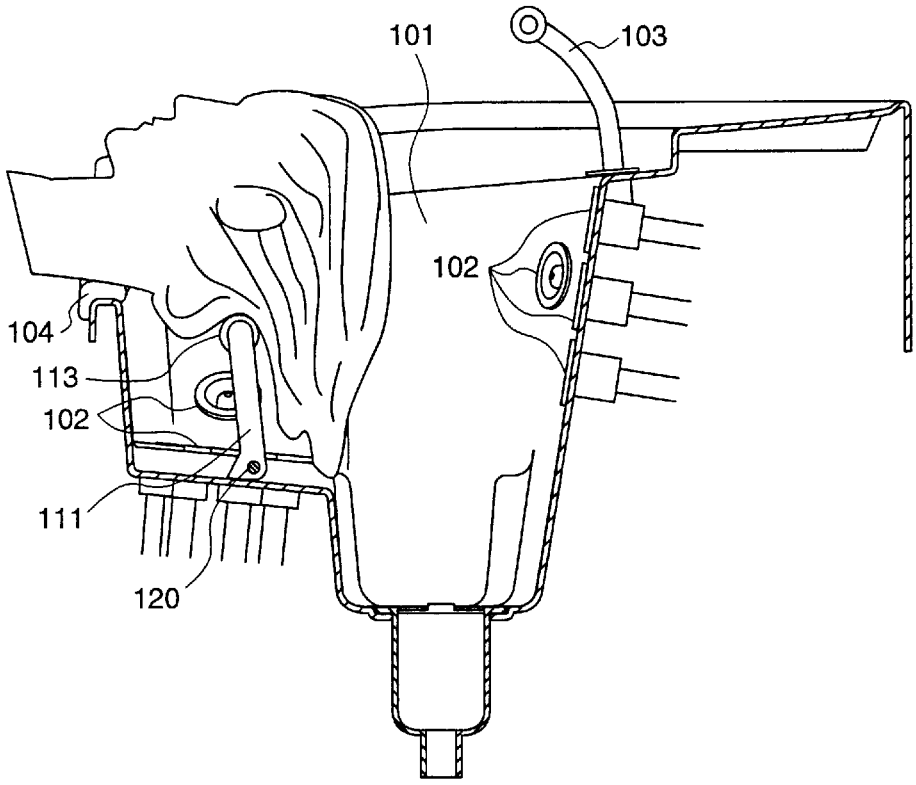
FIG. 6 is a diagram for explaining a hair washing operation of the automatic hair washer according to the first embodiment of the present invention.

In the automatic hair washer according to the first embodiment, as shown in FIG. 6, a person whose hair is to be washed puts his neck on the neck rest 104 in a posture of lying on his back, and inserts his head into the hair washing cistern 101. In this state, shampoo, hot water, or the like is spouted from the shower nozzle 102 and the overhead shower nozzle 103 toward his hair to wash it. At this time, the head support 110 is in the standing state and the head support bar 112 supports the back of his head. Since the head support 110 is placed in the standing state after the rotation of the support leg 111 is stopped in somewhat forward slant state compared with the vertical state by the rotation stopper 130 as shown in FIG. 4, the head support 110 is hard to fall backward when he puts his head on it. In this way, even when the head of the person is inserted deeply into the hair washing cistern 101 in order to wash the back of his head sufficiently, a heavy burden is not put on the back of his neck because the back of his head is supported by head support 110. Since the cushioning material 113 made of urethane rubber or the like is wound around the head support bar 112, the pain caused by that the head support bar 112 touches the back of his head can be relieved.

After the automatic hair washing by the hair washing means 102 and 103, when a person who performs this hair washing finishes the hair washing with hands, the finishing process is carried out in the falling state of the head support 110 as shown in FIG. 5.

In this way, the automatic hair washer according to the first embodiment, which is provided with the hair washing cistern 101 into which the head of a person whose hair is to be washed is inserted and the shower nozzles 102 and 103 which spout hot water into the hair washing cistern 101 to wash the hair of the person, is further provided with the head support 110 for supporting the head of the person, which is attached into the hair washing cistern 110 such that it can stand and fall freely. Therefore, the automatic hair washer can wash the back of his neck sufficiently without putting a heavy burden on his neck.

Figure 7:
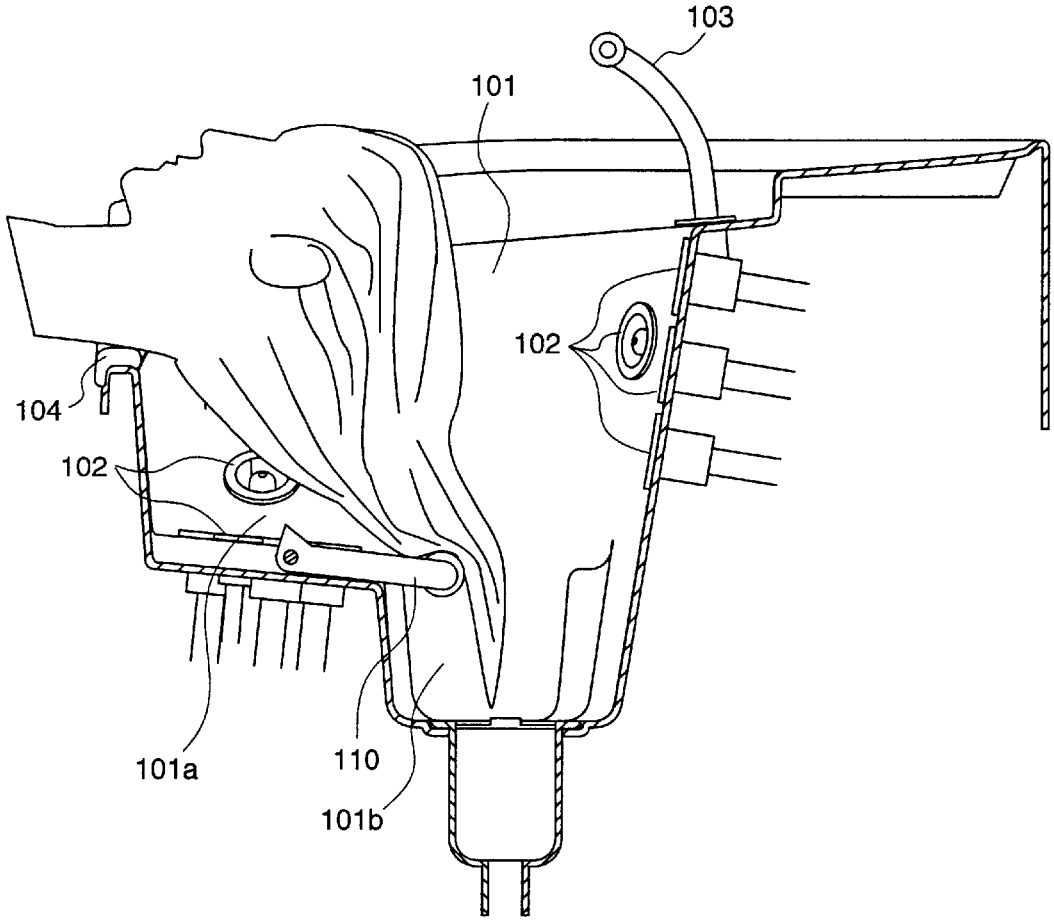
FIG. 7 is a diagram illustrating a situation where the long hair of a person is washed by the automatic hair washer according to the first embodiment of the present invention.

Further, in the automatic hair washer according to the first embodiment, the head support bar 112 supports the head of the person in the standing state of the head support 110 when the automatic hair washing is carried out. However, the head support bar 112 may be used as a hair receiving bar for a person having long hair in the falling state of the head support 110 when the automatic hair washing is carried out, as shown in FIG. 5. When his long hair is washed by the automatic hair washer, the hair which hangs down to the bottom of the hair washing cistern 101 reaches the inner wall of the hair washing cistern 101, and this may give the person an unpleasant feeling. Therefore, in the prior art automatic hair washer, a reticulate hair rest is provided in the hair washing cistern to prevent the long hair from reaching the inner wall of the hair washing cistern. In this case, however, since the hair spreads disorderly on the reticulate hair rest, the hair is entangled intricately due to a shower spouted from a plurality of shower nozzles during hair washing, and this hair entanglement becomes a serious problem in straightening the hair after hair washing. In the automatic hair washer according to this embodiment, as shown in FIG. 7, the head support 110 is attached to the bottom of a shallow portion 1001*a* of the hair washing cistern 101. In the falling state of the head support 110, the head support bar 112 juts over a deep portion 101*b* of the hair washing cistern 101. In the automatic hair washer according to this embodiment, when washing the long hear, the long hair hangs down to the deep portion of the hair washing cistern 101 through the head support bar 112 which juts above the deep portion 101*b* of the hair washing cistern 101 in the falling state of the head support 110 as shown in FIG. 7. Thereby, the hair is prevented from reaching the inner wall of the hair washing cistern 101. Further, even when the stream of the hair washing shower gets strong, the hair is not easily scattered. Therefore, shrinkage or entanglement of the hair caused by the shower spouted during the hair washing is prevented, and hair straightening after the hair washing can be done easily.

Figure 8:
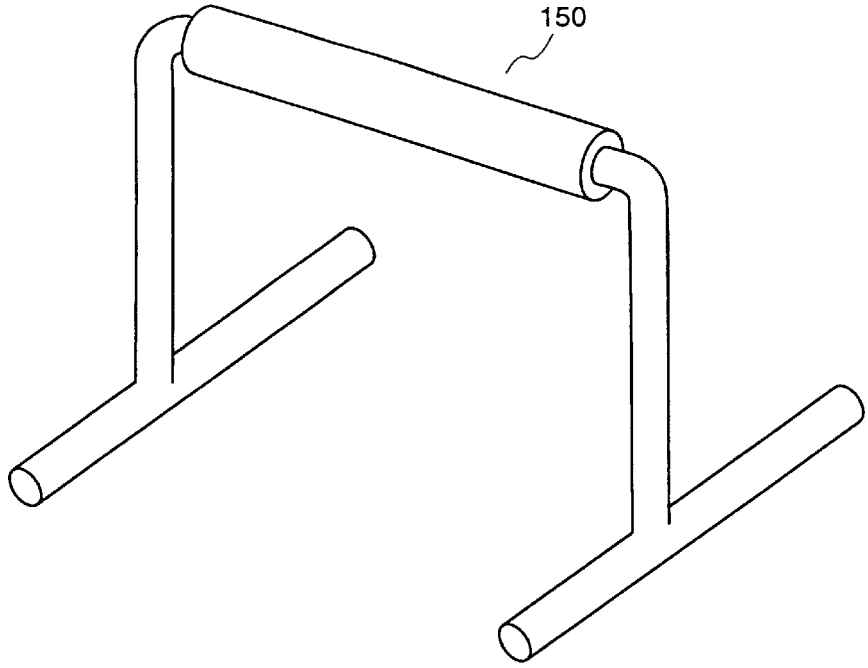
FIG. 8 is a diagram illustrating an another example of the head support.
Figure 9:
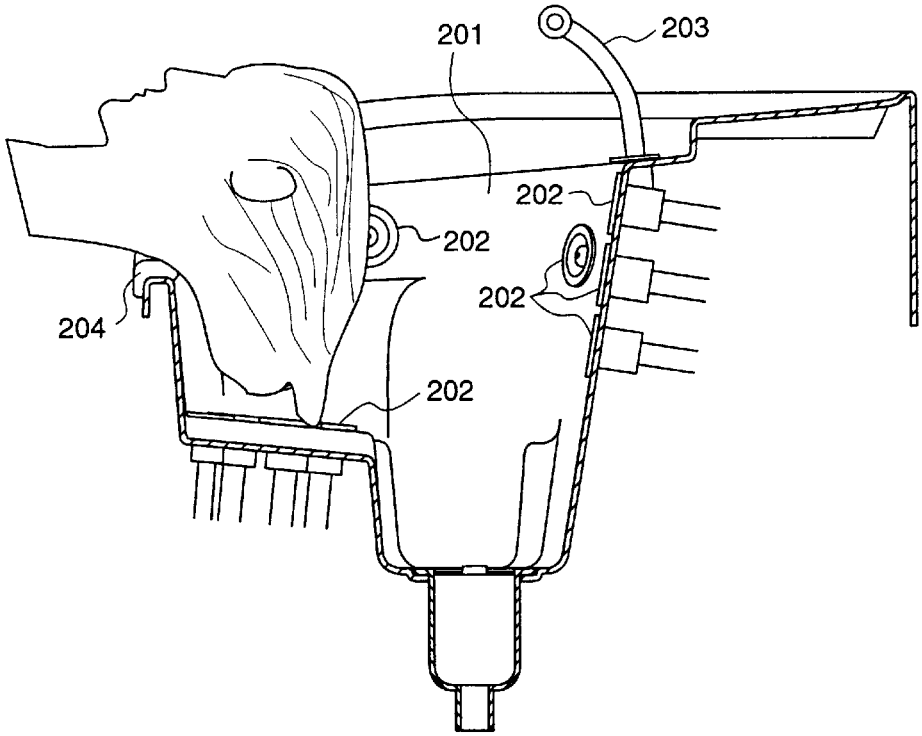
Fig.9 Prior Art
FIG. 9 is a diagram illustrating a situation where a person inserts his head shallowly into the hair washing cistern to have his hair washed by a prior art automatic hair washer.
Figure 10:
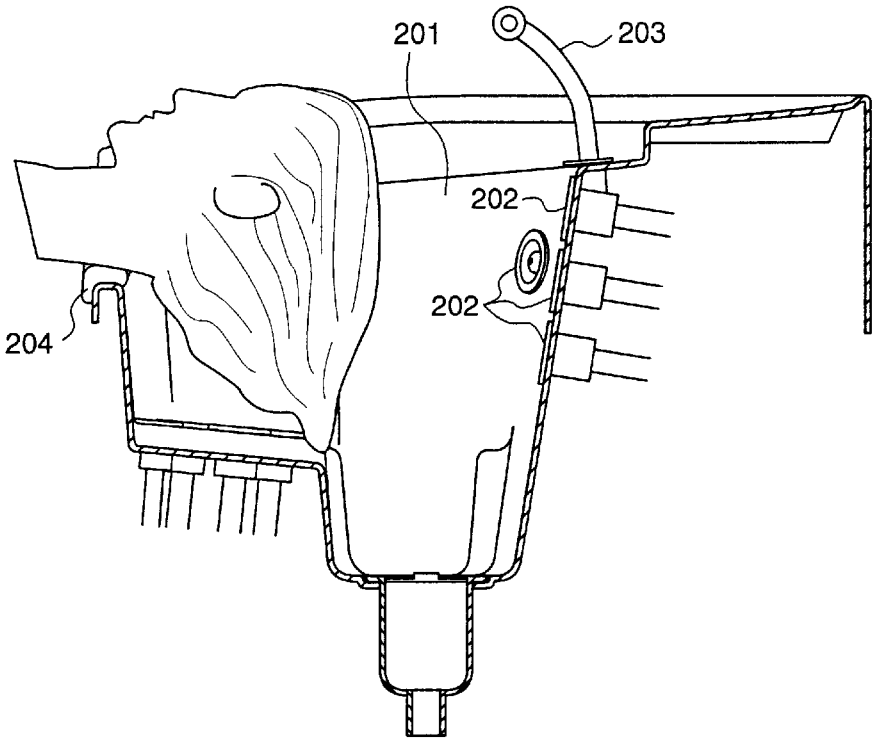
Fig.10 Prior Art
FIG. 10 is a diagram illustrating a situation where a person inserts his head deeply into the hair washing cistern to have his hair washed by the prior art automatic hair washer.

Besides, although the head support 110 is attached to the hair washing cistern 101 such that it can stand up and fall down freely in the above-described embodiment 1, the head support may have any structure so long as it can support the head of the person whose hair is washed, in the hair washing cistern. For example, a separate type head support unit 150 as shown in FIG. 8 may be disposed on the bottom of the front of the hair washing cistern 101.

As described above, according to the present invention, an automatic hair washer, which is provided with a hair washing cistern into which the head of a person whose hair is to be washed can be inserted and hair washing means for spouting hot water into the hair washing cistern to wash the hair of the person, further comprises a head support for supporting the head of the person in the hair washing cistern. Thereby the automatic hair washer can wash the back of his neck sufficiently without putting a heavy burden on his neck.

What is claimed is:

1. In an automatic hair washing apparatus having a cistern into which the head of a person whose hair is being washed is inserted and nozzles for directing water into the cistern, said apparatus including:

a head support having spaced apart legs, each leg being mounted at one end in a bottom wall section of said cistern and a support bar connecting the opposite ends of said legs for supporting the back of the head of the person whose hair is being washed;

pivot means for rotatably supporting said one end of each leg in the bottom wall section of the cistern so that the legs can rotate between a raised position wherein the support bar is elevated above said bottom wall section and a lowered position wherein the legs are about parallel with said bottom wall section.

2. The apparatus of claim 1 wherein said cistern has a well located behind said bottom wall section, and said legs having a length such that the support bar is suspended over the well when the legs are in the lowered position wherein the hair of a person whose hair is being washed can hang down over the support bar into the well.

3. The apparatus of claim 1 wherein the support bar is covered with soft material.

4. The apparatus of claim 1 that includes a plurality of spray nozzles mounted on side walls and a back wall of the cistern for directing water toward the hair on the back and the side of said person and overhead spray nozzles mounted over the top of the cistern for directing water toward the hair on the forehead of said person.

* * * * *

UNITED STATES PATENT AND TRADEMARK OFFICE

CERTIFICATE OF CORRECTION

PATENT NO. : 6,526,605 B2 
DATED : March 4, 2003
INVENTOR(S) : Hirohisa Shimizu

It is certified that error appears in the above-identified patent and that said Letters Patent is hereby corrected as shown below:

Title page,
Item [30], Foreign Application Priority Data, should read
-- Nov. 1, 2000 (JP) …….. 2000-344997 --

Signed and Sealed this

Eighteenth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,526,605 B2
DATED : March 4, 2003
INVENTOR(S) : Hirohisa Shimizu

It is certified that error appears in the above-identified patent and that said Letters Patent is hereby corrected as shown below:

Title page,
Item [30], should read as follows:

-- [30] Foreign Application Priority Data

Nov. 1, 2000 (JP) …….. 2000-334997 --

Signed and Sealed this

Eleventh Day of May, 2004

JON W. DUDAS
*Acting Director of the United States Patent and Trademark Office*